US006854244B2

(12) United States Patent
Pike

(10) Patent No.: US 6,854,244 B2
(45) Date of Patent: Feb. 15, 2005

(54) CARTON FILLING APPARATUS

(75) Inventor: Brian Charles Pike, Weston-super-Mare (GB)

(73) Assignee: Bradman Lake Limited, Brislington Bristol (GB)

( * ) Notice: Subject to any disclaimer, the term of this patent is extended or adjusted under 35 U.S.C. 154(b) by 0 days.

(21) Appl. No.: 10/352,993

(22) Filed: Jan. 29, 2003

(65) Prior Publication Data

US 2003/0163974 A1 Sep. 4, 2003

(30) Foreign Application Priority Data

Jan. 29, 2002 (GB) ..... 0201981

(51) Int. Cl.[7] ..... B65B 5/08
(52) U.S. Cl. ..... 53/252; 53/247
(58) Field of Search ..... 53/235, 250, 251, 53/252, 255, 247, 258; 414/626

(56) References Cited

U.S. PATENT DOCUMENTS

| | | | | | |
|---|---|---|---|---|---|
| 2,133,248 | A | * | 10/1938 | Jones | 53/56 |
| 2,285,283 | A | * | 6/1942 | Jones | 53/56 |
| 2,828,595 | A | * | 4/1958 | Talbot et al. | 53/251 |
| 2,907,155 | A | * | 10/1959 | Engleson et al. | 53/506 |
| 2,930,172 | A | * | 3/1960 | Pettee et al. | 53/529 |
| 3,105,337 | A | * | 10/1963 | Clanin et al. | 53/251 |
| 3,193,981 | A | * | 7/1965 | Whitecar | 53/65 |
| 3,269,091 | A | * | 8/1966 | Martin | 53/252 |
| 3,338,009 | A | * | 8/1967 | Stevens | 53/245 |
| 3,821,874 | A | | 7/1974 | Jones | |
| 3,906,705 | A | | 9/1975 | Beck et al. | |
| 4,250,693 | A | | 2/1981 | Andersson | |
| 4,578,927 | A | * | 4/1986 | Scarpa et al. | 53/506 |
| 4,686,813 | A | * | 8/1987 | Sawada | 53/446 |
| 4,875,328 | A | * | 10/1989 | Meyer | 53/529 |
| 4,936,077 | A | | 6/1990 | Langen et al. | |
| 4,996,820 | A | * | 3/1991 | Harrison, Jr. | 53/69 |
| 5,052,544 | A | | 10/1991 | Anderson | |
| 5,060,455 | A | * | 10/1991 | Schmeisser | 53/448 |
| 5,129,777 | A | * | 7/1992 | Pohjonen et al. | 414/280 |
| 5,175,976 | A | * | 1/1993 | Petry et al. | 53/252 |
| 5,339,944 | A | | 8/1994 | Ostholt et al. | |
| 5,430,990 | A | | 7/1995 | Long | |
| 5,457,941 | A | | 10/1995 | Long et al. | |
| 5,481,848 | A | * | 1/1996 | Tagliaferri et al. | 53/157 |
| 5,611,193 | A | | 3/1997 | Farrelly | |
| 6,170,237 | B1 | * | 1/2001 | Wipf | 53/455 |

FOREIGN PATENT DOCUMENTS

| | | |
|---|---|---|
| EP | 0 765 810 | 4/1997 |
| GB | 1 260 313 | 1/1972 |
| GB | 2 128 956 | 5/1984 |
| GB | 2 260 743 | 4/1993 |

* cited by examiner

*Primary Examiner*—Eugene Kim
*Assistant Examiner*—Paul Durand
(74) *Attorney, Agent, or Firm*—Young & Thompson

(57) ABSTRACT

A carton filling apparatus has a primary conveyor section 1 for transporting cartons 2 along the length of the apparatus, and a secondary conveyor section 3 for conveying objects 4 intended to be inserted into the cartons in parallel with the cartons. Each object 4 is aligned with an open mouth of a carton 2. A pushing mechanism incorporates an overhead gantry arm 5 arranged above the conveyors to be moved along the conveyors in the longitudinal direction. A pusher bar 8 is arranged to be moved along the gantry arm over the conveyors. Pushers 9 act upon the objects in such a way as to move the objects into the cartons as the cartons and objects are moved along synchronously on the conveyors.

5 Claims, 3 Drawing Sheets

CARTON FILLING APPARATUS

BACKGROUND OF THE INVENTION

When saleable products are to be inserted into cartons the usual method is to move the cartons and the products along a conveyor, side by side, and cause the products to be pushed into the cartons by individual pusher devices which are moved across the conveyor. The mechanism incorporating the pusher devices necessarily comprises a number of working parts and usually occupies a substantial space to one side of the conveyor to provide a region for location of the pusher devices when they are in their extended state. It is an objection of this invention to provide a carton filling apparatus which is compact in structure.

SUMMARY OF THE INVENTION

According to the present invention there is provided a carton filling apparatus incorporating a primary conveyor section for transporting cartons along the length of the apparatus, a secondary conveyor section for conveying objects intended to be inserted into the cartons in parallel with the cartons, such that each object is aligned with an open mouth of a carton, and a pushing mechanism comprising an overhead gantry arm arranged above the conveyors to be moved along the conveyors in the longitudinal direction, and a pusher bar arranged to be moved along the gantry arm over the conveyors and carrying pushers to act upon the objects in such a way as to move the objects into the cartons as the cartons and objects are moved along synchronously on the conveyors.

With such an apparatus the pushing mechanism can largely be confined within the bounds of the width of the conveyor sections. The combination of the movement of the overhead gantry arm in the longitudinal direction and of the pusher bar (along the gantry arm) essentially creates a diagonal movement of the pushers to cause the objects to be moved smoothly into the cartons whilst they are being transported by the conveyor sections down the length of the apparatus. Ideally the pusher bar will be arranged to be moved at right angles to the direction of movement of the gantry arm.

When the objects have been pushed fully home into the cartons, then the pushing mechanism can be operated in the reverse direction to transport the pushers back to a location where they can act upon a further set of objects. For this purpose it is desirable that the pushers should be carried on the pusher bar by retraction members which enable the pushers to be raised above the level of the objects, so that they will not foul any new set of objects as they are moved back to the start position. The pusher bar can be fitted with any number of pushers, but ideally will carry 2 to 4 pushers.

Whilst the two conveyor sections may be separate it is also possible for the two conveyor sections to be provided as parts of a single conveyor.

BRIEF DESCRIPTION OF THE DRAWINGS

The invention may be performed in various ways and a preferred embodiment thereof will now be described, with reference to the accompanying drawings, in which.

DETAILED DESCRIPTION OF THE INVENTION

Figure 1A:
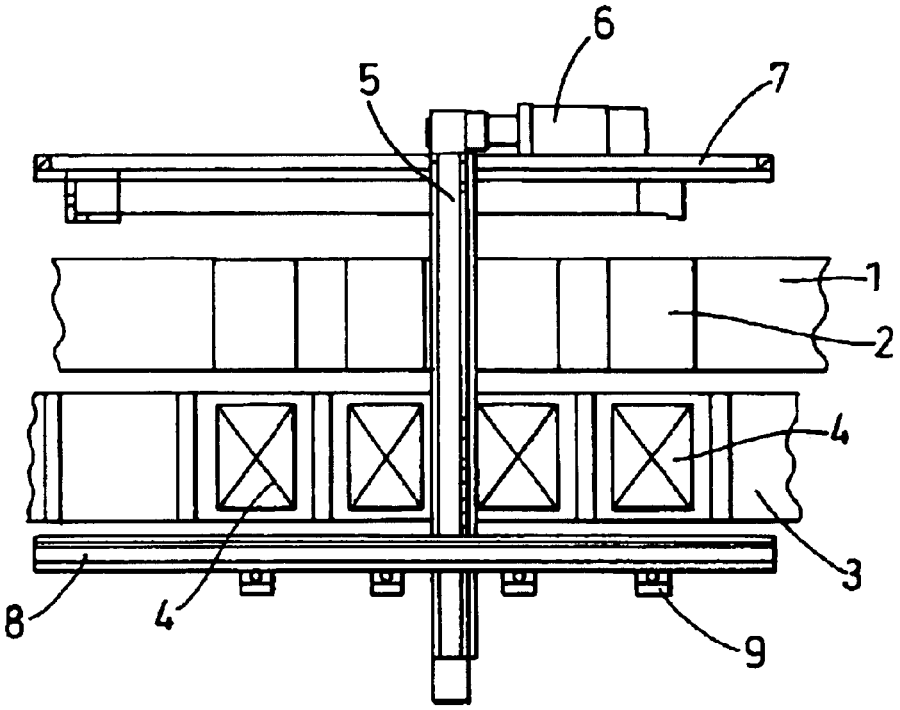
FIGS. 1A and 1B illustrate a carton filling apparatus of this invention in plan and side views respectively.

As shown in the drawings, a first conveyor section 1 carries cartons 2 and a second conveyor section 3 carries objects 4 to be inserted into the cartons. The conveyor sections 1 and 3 are moved along at the same speed so that the objects 4 are always facing open mouths of the cartons 2. A pushing mechanism is carried by a gantry arm 5. This can be moved by a motor 6 along a rail 7 at the same speed as the conveyors 1 and 3. The gantry arm 5 carries a pusher bar 8 which will be moved along the gantry arm 5. The pusher bar 8 carries four pushers 9.

Figure 2A:
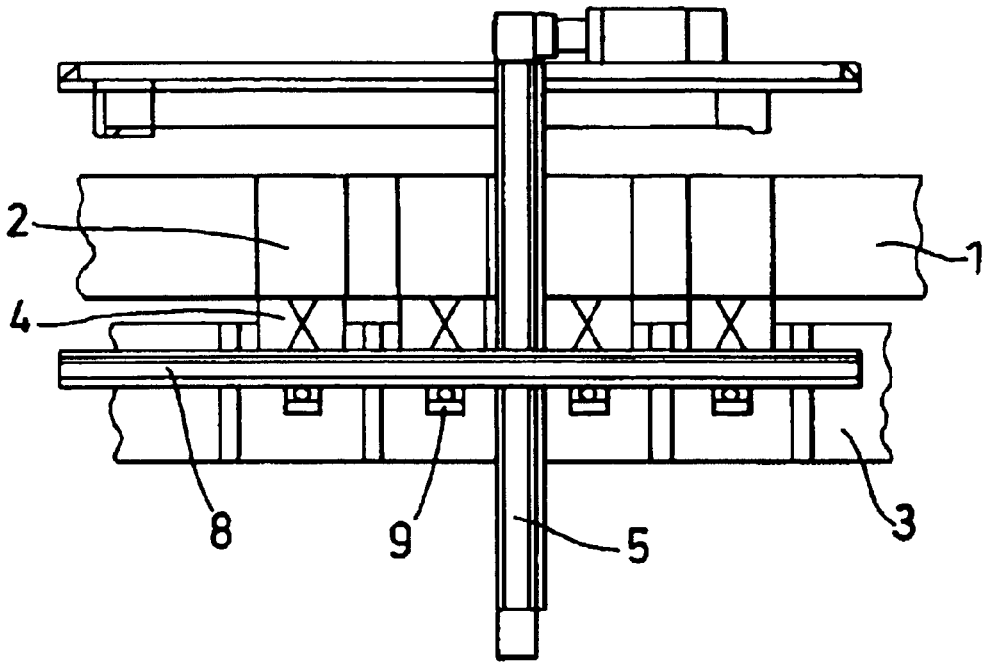
FIGS. 2A and 2B and FIGS. 3A and 3B are similar views of the same apparatus of FIG. 1 showing differing positions of a pushing mechanism as objects are moved into cartons.
Figure 2B:
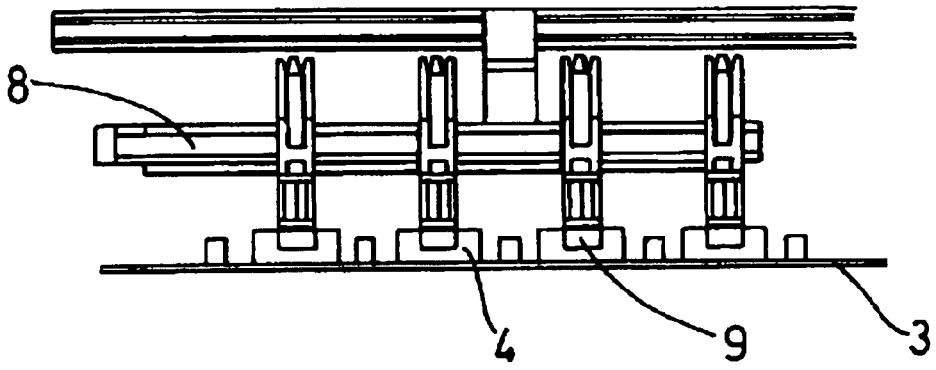
Figure 3A:
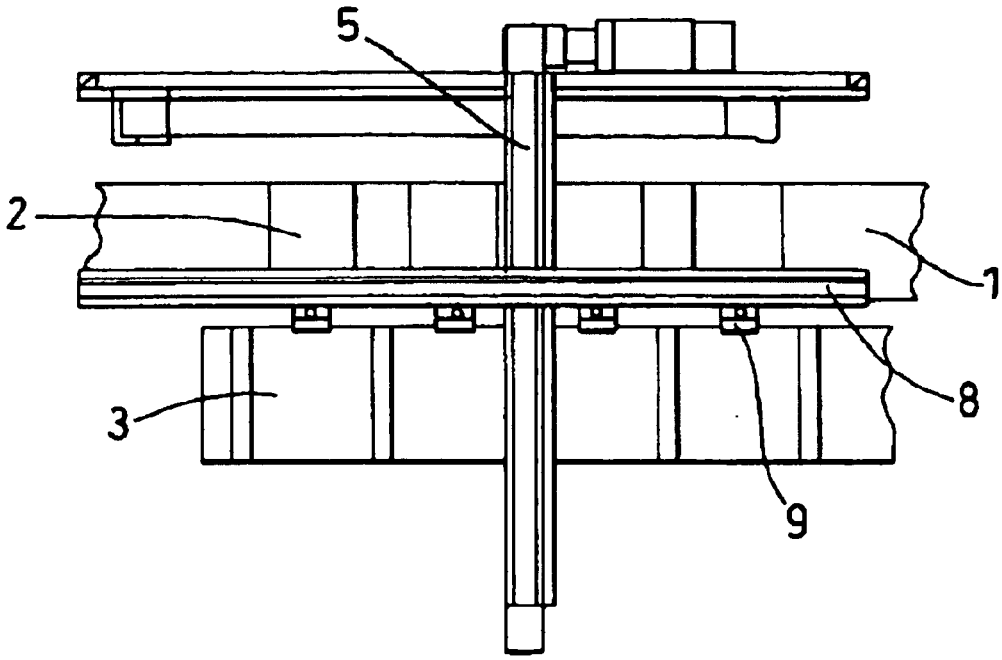
Figure 3B:
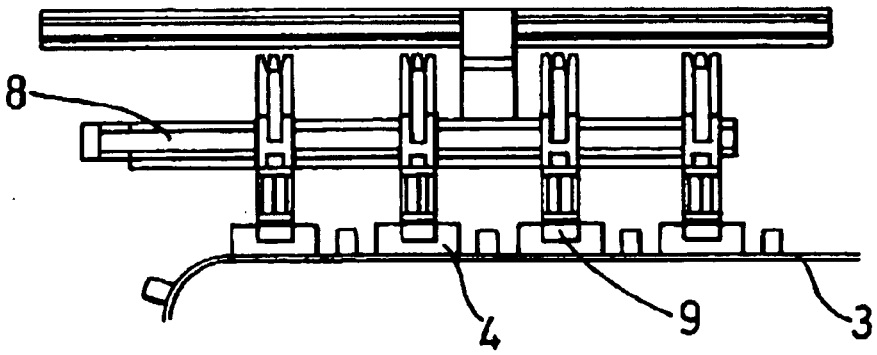

The combined movement at the same time of the gantry arm 5 and of the pusher bar 8 along the gantry arm results in a diagonal movement of the pushers 9 across the conveyor 3, thus causing the objects 4 to be moved progressively into the cartons 2. An intermediate loading position is illustrated in FIG. 2 and the fully loaded position is shown in FIG. 3.

Figure 1B:
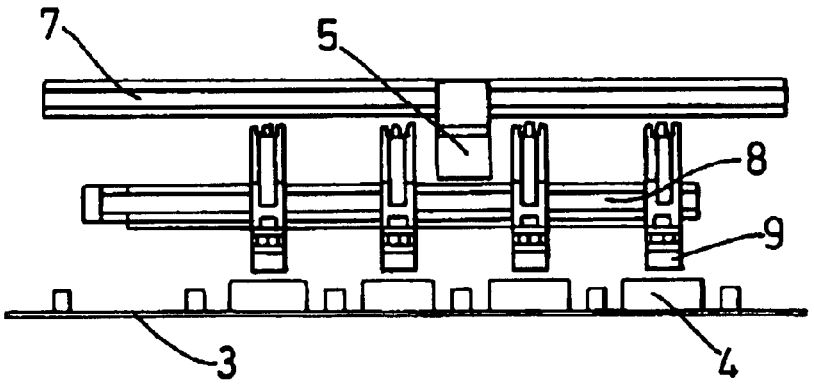

Once the objects have been moved into the cartons 2 then the pushers 9 will be raised (by piston devices, for example), as shown in FIG. 1B. The gantry arm 5 will then be moved back to a start position and the pusher bar 8 will be moved out towards the free end of the gantry arm 5. During this movement the raised pushers 9 can move across a new set of objects 4 (as can be seen from FIG. 1B). The pushers 9 will then be lowered into the operating position and a new sequence will be initiated to move the next set of four objects 4 into the cartons 2.

What is claimed is:

1. A carton filling apparatus incorporating a primary conveyor section for transporting cartons along the length of the apparatus, a secondary conveyor section, in parallel with the primary conveyor section, for conveying objects to be inserted into the cartons, such that each object is aligned with an open mouth of the carton and a pushing mechanism comprised of a stationary rail, an overhead gantry arm, arranged above and extending across the conveyors, to be moved along said rail in a reciprocating manner above the conveyors in the longitudinal direction of the conveyors and a pusher bar arranged to be moved along the gantry arm and carrying pushers to act upon the objects in such a way as to move the objects into the cartons as the cartons and objects are moved synchronously along the conveyors.

2. Apparatus according to claim 1, wherein the pusher bar is arranged to be moved at right angles to the direction of movement of the gantry arm.

3. Apparatus according to claim 1, further comprising retraction members on the pusher bar that carry the pushers and enable the pushers to be raised above the level of the objects.

4. Apparatus according to claim 1, wherein the pusher bar carries 2 to 4 pushers.

5. Apparatus according to claim 1, wherein the two conveyor sections are provided as parts of a single conveyor.

* * * * *